US007963800B1

(12) United States Patent
Chen et al.

(10) Patent No.: US 7,963,800 B1
(45) Date of Patent: Jun. 21, 2011

(54) ELECTRICAL CONNECTOR HAVING IMPROVED HOUSING AND SHELL

(75) Inventors: Feng Chen, Guang-Dong (CN); Feng Zhu, Guang-Dong (CN); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/716,267

(22) Filed: Mar. 2, 2010

(51) Int. Cl.
*H01R 13/648* (2006.01)

(52) U.S. Cl. ..... 439/607.27; 439/79

(58) Field of Classification Search ..... 439/79, 439/83, 350–355, 357, 607.27, 607.28, 607.34, 439/607.35
See application file for complete search history.

(56) References Cited

U.S. PATENT DOCUMENTS 3,210,225 A * 10/1965 Brixey, Jr. ..... 438/343
6,346,009 B1 * 2/2002 Lin ..... 439/607.01
6,568,966 B1 * 5/2003 Korsunsky et al. ..... 439/676
7,037,135 B2 * 5/2006 Chen et al. ..... 439/607.08
7,658,624 B2 * 2/2010 Fang et al. ..... 439/79

* cited by examiner

*Primary Examiner* — Thanh-Tam T Le
(74) *Attorney, Agent, or Firm* — Cheng-Ju Chiang

(57) ABSTRACT

An electrical connector is adapted for being mounted to a printed circuit board. The electrical connector includes a housing, a plurality of terminals, a shell and a bracket. A front edge of a periphery of the housing is protruded outward to form a flange. The terminals are received in the housing. The shell surrounds the housing. A front edge of the shell abuts against the flange. The bracket has a base board, and two opposite ends of the base board extends downward to form two blocking boards. Bottoms of the blocking boards extend outward to form two soldering boards. The base board of the bracket is mounted on the top board of the shell. The blocking boards are mounted on the two side boards. Front edges of the base board and the blocking boards of the bracket abut against the flange.

5 Claims, 3 Drawing Sheets

ELECTRICAL CONNECTOR HAVING IMPROVED HOUSING AND SHELL

BACKGROUND OF THE INVENTION

1. Field of the Invention

The present invention generally relates to an electrical connector, and more particularly to an electrical connector having a shell capable of being assembled to a housing thereof tightly.

2. The Related Art

A conventional electrical connector generally includes a housing, a shell and a plurality of terminals. The housing has a base portion, and a middle of a front of the base portion extends forward to form a tongue-shaped portion. A bottom of the tongue-shaped portion defines a plurality of terminal receiving grooves further penetrating through a rear of the base portion. When the electrical connector is assembled, the terminals are fastened to the terminal receiving grooves. The shell is mounted around the housing with an inserting space formed between the tongue-shaped portion and the shell. However, the base portion of the housing and the shell are sometimes assembled loosely to form a gap therebetween, dust is easily through the gap to enter an electronic product where the electrical connector is used, so the performance of the electronic product is affected and the failure of the electronic product may be caused.

SUMMARY OF THE INVENTION

An object of the present invention is to provide an electrical connector adapted for being mounted to a printed circuit board. The electrical connector includes a housing of rectangular shape, a plurality of terminals, a shell and a bracket. A front edge of a periphery of the housing is protruded outward to form a flange. The terminals are received in the housing. The shell surrounds the housing and has a bottom board, a top board and two side boards. Front edges of the bottom board, the top board and the side board abut against the flange. The bracket has a base board, and two opposite ends of the base board extends downward to form two blocking boards. Bottoms of the blocking boards extend outward to form two soldering boards. The base board of the bracket is mounted on the top board of the shell. The blocking boards are mounted on the two side boards. Front edges of the base board and the blocking boards of the bracket abut against the flange.

As described above, the housing has the flange extended from the front edge of the periphery thereof. When the shell is assembled to the housing, the front edge of the shell abuts against the flange and no gap is formed between the front edge of the shell and the flange. Such tight connection of the front edge of the shell and the flange can avoid dust entering an electronic product where the electrical connector is used and then improve the performance of the electronic product.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
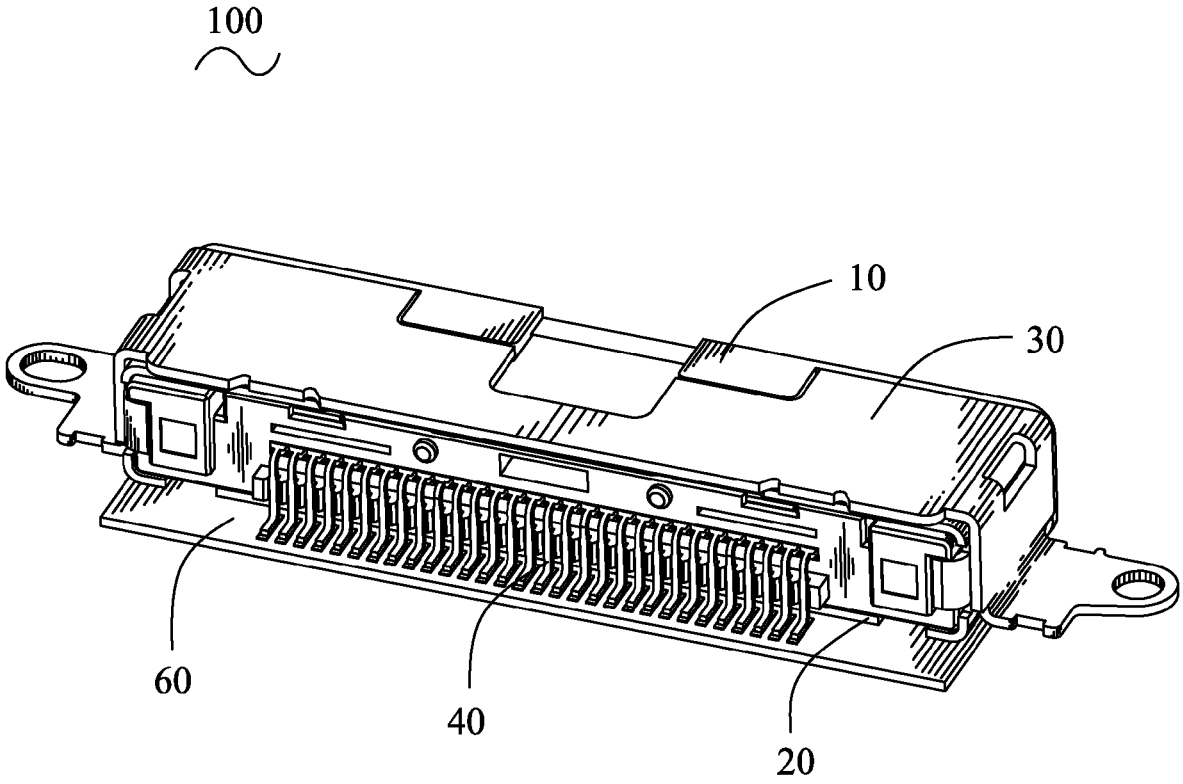
FIG. 1 is a perspective view of an electrical connector in accordance with the present invention, wherein the electrical connector is mounted to a printed circuit board.

With reference to FIG. 1, an electrical connector 100 in accordance with the present invention is shown. The electrical connector 100 includes a housing 10, a shell 20, a bracket 30, a plurality of terminals 40 and a plurality of ground pieces 50. The electrical connector 100 is mounted on a printed circuit board 60.

Figure 2:
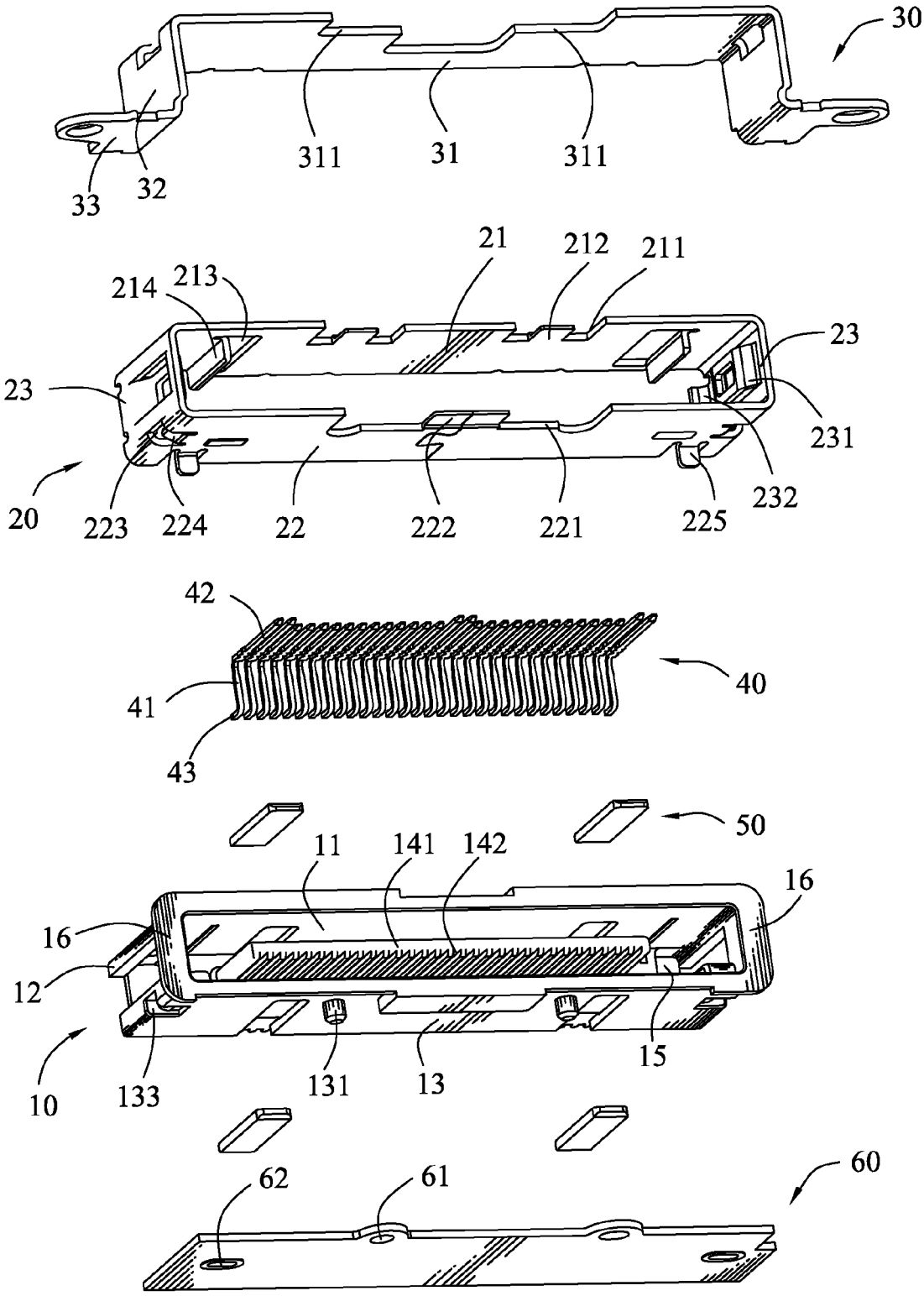
FIG. 2 is an exploded perspective view of the electrical connector and the printed circuit board of FIG. 1.
Figure 3:
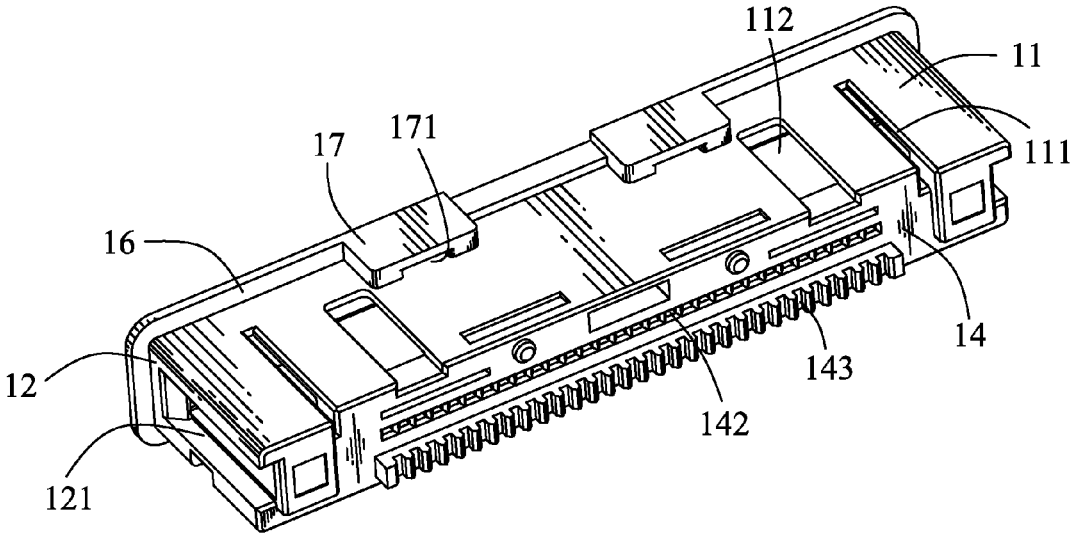
FIG. 3 is a perspective view of a housing of the electrical connector of FIG. 1.
Figure 4:
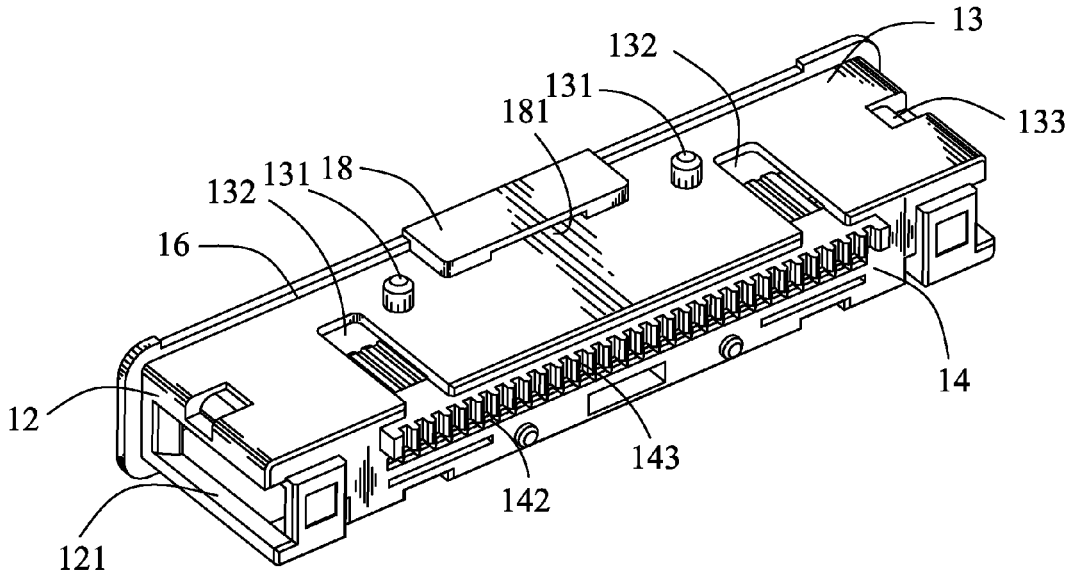
FIG. 4 is another perspective view of the housing of the electrical connector of FIG. 1.

Referring to FIG. 2, FIG. 3 and FIG. 4, the housing 10 defines a top wall 11, two ends of the top wall 11 respectively extend downward to form a side wall 12, a bottom wall 13 connected with bottoms of the two side walls 12 and a rear wall 14 connected with rears of the top wall 11, the two side walls 12 and the bottom wall 13. The top wall 11, the two side walls 12, the bottom wall 13 and the rear wall 14 are interconnected to show a box shape with an inserting space 15 thereamong. A front edge of a periphery of the housing 10 is extended outward to form a flange 16. The top wall 11 has two first protrusions 17 protruded upward from two spaced portions of a front thereof. Bottoms of rears of the two first protrusions 17 define two first inserting grooves 171. Two ends of the top wall 11 longitudinally define two fixing slots 111 further penetrating through the rear wall 14. The two side walls 12 respectively define a fastening groove 121 further penetrating through the rear wall 14. A middle of a front of the bottom wall 13 has two inserting pillars 131 spaced apart from each other. The middle of the front of the bottom wall 13 extends downward to form a second protrusion 18 located between the two inserting pillars 131. A top of a rear of the second protrusion 18 defines a second inserting groove 181. The top wall 11 and the bottom wall 13 define a plurality of fixing grooves 112,132 vertically penetrating therethrough and further penetrating through the rear wall 14. A joint of each side wall 12 and the bottom wall 13 defines a clipping groove 133 at a middle thereof. A middle of a front of the rear wall 14 protrudes forward to form a tongue-shaped portion 141, a downside of the tongue-shaped portion 141 horizontally defines a plurality of terminal channels 142 arranged at regular intervals and further penetrating through the rear wall 14. A bottom of a rear of the rear wall 14 defines a plurality of terminal locating grooves 143 vertically penetrating therethrough and located under the corresponding terminal channels 142.

Referring to FIG. 2, the shell 20 defines a top board 21, a bottom board 22 and two side boards 23 connected with the top board 21 and the bottom board 22. A middle of a front of the top board 21 defines two holding grooves 211 spaced apart from each other. Middles of rear ends of the two holding grooves 211 extend forward to form two first inserting pieces 212. Two opposite ends of the top board 21 defines two mouths 213 vertically penetrating therethrough. An outside of the mouth 213 extends downward to form a fixing piece 214. A middle of a front of the bottom board 22 is cut off to define an open groove 221. A middle of a rear of the open groove 221 extends forward to form a second inserting piece 222. A joint of each side board 23 and the bottom board 22 defines a buckling groove 223 at a middle thereof. An inside of the buckling groove 223 extends inward to form a buckling piece 224. A rear of the bottom board 22 has two fixing feet 225 extended downward from two opposite ends thereof. Middles of the two side boards 23 are respectively arched inward to form a trapezoid fastening portion 231. A middle of a rear of the side board 23 extends inward to form a clipping portion 232.

Referring to FIG. 2, the bracket 30 has a rectangular base board 31. Two opposite ends of the base board 31 extend downward to form two blocking boards 32. Bottoms of the blocking boards 32 extend outward to form two soldering boards 33. A middle of a front edge of the base board 31 defines two locking grooves 311 spaced from each other.

Referring to FIG. 2, the terminals 40 is integratedly molded with the housing 10. The terminal 40 has a long-strip locating portion 41, and two ends of the locating portion 41 extend towards two opposite directions perpendicular to the locating portion 41 to form a contacting portion 42 and a soldering portion 43, respectively.

Referring to FIG. 2, the printed circuit board 60 defines two inserting holes 61 adjacent to a front side edge thereof and two clipping holes 62 adjacent to two opposite end edges thereof.

Referring to FIGS. 1-4, when the electrical connector 100 is assembled, the terminals 40 are molded to the housing 10 with the contacting portions 42 being received in the terminal channels 142 and the locating portions 41 being fastened in the corresponding terminal locating grooves 143. A plurality of the ground pieces 50 are received in the fixing grooves 112,132 of the housing 10 respectively. The shell 20 is mounted around the housing 10, wherein the first inserting pieces 212 are inserted into the first inserting grooves 171 of the housing 10, the second inserting piece 222 are inserted into the second inserting groove 181, the buckling piece 224 are buckled in the clipping groove 133, the fastening portion 231 are received in the fastening groove 121, the clipping portion 232 are buckled in a rear of the fastening groove 121, and the fixing pieces 214 are inserted into the fixing slots 111. The first protrusions 17 are received in the holding grooves 211 and the second protrusion 18 is received in the open groove 221. A front edge of the shell 20 abuts against a rear of the flange 16. The ground pieces 50 are soldered to an inside of a top of the shell 20. Then, the bracket 30 is mounted on the shell 20 with an inside of the base board 31 of the bracket 30 being soldered to a top surface of the top board 21 of the shell 20 and an inside of the blocking board 32 of the bracket 30 being soldered to an outside of the side wall 12 of the shell 20. The first protrusions 17 are received in the locking grooves 311. Front edges of the base board 31 and the blocking boards 32 of the bracket 30 abut against the rear of the flange 16. Peripheries of the base board 31 and the blocking boards 32 of the bracket 30 are flush with a periphery of the flange 16. The inserting pillars 131 of the housing 10 are inserted into the inserting holes 61 of the printed circuit board 60. The fixing feet 225 of the shell 20 are inserted into the clipping holes 62 of the printed circuit board 60. The soldering portions 43 are soldered to the printed circuit board 60.

As described above, the housing 10 has the flange 16 extended from the front edge of the periphery thereof. When the shell 20 is assembled to the housing 10, the front edge of the shell 20 abuts against the flange 16 and no gap is formed between the front edge of the shell 20 and the flange 16. Such tight connection of the front edge of the shell 20 and the flange 16 can avoid dust entering an electronic product where the electrical connector 100 is used and then improve the performance of the electronic product.

What is claimed is:

1. An electrical connector, adapted for being mounted to a printed circuit board, comprising:

a housing of rectangular shape, a front edge of a periphery of the housing protruded outward to form a flange;

a plurality of terminals received in the housing;

a shell surrounding the housing, the shell having a bottom board, a top board and two side boards, front edges of the bottom board, the top board and the side boards abutting against the flange; and a bracket having a base board, two opposite ends of the base board extending downward to form two blocking boards, bottoms of the blocking boards extending outward to form two soldering boards, the base board of the bracket mounted on the top board of the shell, the blocking boards mounted on the two side boards, front edges of the base board and the blocking boards of the bracket abutting against the flange;

wherein a top wall of the housing has two first protrusions protruded upward from two spaced portions of a front thereof, rears of the first protrusions define two first inserting grooves, a front of the top board defines two holding grooves spaced apart from each other for receiving the two first protrusions, middles of rear ends of the holding grooves extend forward to form two first inserting pieces inserted into the first inserting grooves, and a middle of a front of the base board defines two locking grooves spaced from each other for receiving the two first protrusions.

2. The electrical connector as claimed in claim 1, wherein peripheries of the base board and the blocking boards of the bracket are flush with a periphery of the flange.

3. The electrical connector as claimed in claim 1, wherein a bottom wall of the housing has a second protrusion protruded downward from a front thereof, a rear of the second protrusion defines a second inserting groove, a front of the bottom board defines an open groove for receiving the second protrusion, and a middle of a rear end of the open groove extends forward to form a second inserting piece inserted into the second inserting groove.

4. An electrical connector, adapted for being mounted to a printed circuit board, comprising:

a housing of rectangular shape, a front edge of a periphery of the housing protruded outward to form a flange;

a plurality of terminals received in the housing;

a shell surrounding the housing, the shell having a bottom board, a top board and two side boards, front edges of the bottom board, the top board and the side boards abutting against the flange; and a bracket having a base board, two opposite ends of the base board extending downward to form two blocking boards, bottoms of the blocking boards extending outward to form two soldering boards, the base board of the bracket mounted on the top board of the shell, the blocking boards mounted on the two side boards, front edges of the base board and the blocking boards of the bracket abutting against the flange;

wherein a bottom wall of the housing has a second protrusion protruded downward from a front thereof, a rear of the second protrusion defines a second inserting groove, a front of the bottom board defines an open groove for receiving the second protrusion, and a middle of a rear end of the open groove extends forward to form a second inserting piece inserted into the second inserting groove.

5. The electrical connector as claimed in claim 4, wherein peripheries of the base board and the blocking boards of the bracket are flush with a periphery of the flange.

* * * * *